United States Patent [19]

Kobayashi et al.

[11] Patent Number: 5,033,445

[45] Date of Patent: Jul. 23, 1991

[54] ELECTRONIC DISTRIBUTION TYPE IGNITION SYSTEM

[75] Inventors: Ryoichi Kobayashi, Ibaraki; Noriyoshi Urushiwara, Katsuta, both of Japan

[73] Assignee: Hitachi, Ltd., Tokyo, Japan

[21] Appl. No.: 548,840

[22] Filed: Jul. 6, 1990

[30] Foreign Application Priority Data

Jul. 7, 1989 [JP] Japan ..... 1-174143

[51] Int. Cl.[5] ..... F02P 3/12

[52] U.S. Cl. ..... 123/644; 123/643

[58] Field of Search ..... 123/643, 644, 633; 315/209 T

[56] References Cited

U.S. PATENT DOCUMENTS

| | | | |
|---|---|---|---|
| 3,377,998 | 4/1968 | Adams et al. | 123/644 |
| 3,575,154 | 4/1971 | Taylor | 123/644 |
| 4,147,145 | 4/1979 | Domland et al. | 123/644 |
| 4,153,032 | 5/1979 | Chateáu | 123/644 |
| 4,176,645 | 12/1979 | Jundt et al. | 123/644 |
| 4,366,800 | 1/1983 | Seegar et al. | 123/644 |
| 4,380,989 | 4/1983 | Iakaki | 123/644 |
| 4,750,467 | 6/1988 | Noubalfan | 123/644 |
| 4,836,176 | 6/1989 | Fujino et al. | 123/644 |
| 4,949,697 | 8/1990 | Ookawa | 123/644 |

*Primary Examiner*—Raymond A. Nelli

*Attorney, Agent, or Firm*—Antonelli, Terry, Stout & Kraus

[57] ABSTRACT

This specification discloses an electronic distribution type ignition system wherein at least two ignition coils are provided, and wherein the secondary voltage of the ignition coils is directly supplied to spark plugs. An ignition system according to this invention comprises switching circuits for controlling the supply of a primary voltage to said, ignition coils, a resistance element wherein a current flows selectively which corresponds to a primary current for each of two ignition coils, supplied through two of said switching circuit, current control circuits for detecting a terminal voltage of said resistance element and for controlling, according to said terminal voltage, the primary current flowing through each said igniton coil so as to be at a target value, and a board having said resistance element formed thereon.

9 Claims, 6 Drawing Sheets

ELECTRONIC DISTRIBUTION TYPE IGNITION SYSTEM

BACKGROUND OF THE INVENTION

This invention relates to a so-called electronic distribution type ignition system which has done away with the distributor for supplying a high voltage from the ignition coil to the spark plugs, and more particularly to an electronic distribution type ignition system suitable for multicylinder engines such as automotive gasoline engines.

In engines incorporating a plurality of cylinders, such as automotive gasoline engines, for example, it has been a general practice to use a distributor for high-voltage power supply from the ignition coil to the spark plugs. Lately, an electronic distribution type ignition system has been used commercially which has one-to-one or two-to-one combinations of spark plugs and ignition coils by which ignition is controlled without using a distributor.

In the electronic distribution type ignition system, it is necessary to provide each ignition coil with a power transistor for control of power supply to the ignition coil, and a current-detecting resistance element and a feedback control circuit to control the primary current flowing through the ignition coils at a predetermined value.

In designing an ignition system to comply with the above requirement, it has been practiced to put the control circuit and circuit elements into common use for a plurality of ignition coils in order to realize a whole ignition control circuit in a reduced size and decrease production cost.

One example of this can be seen in JP-A-60-09667 for which the patent application has been filed on Apr. 2, 1984 and laid open later.

According to the disclosure of this publication, it has been proposed to provide a common current detection circuit for a plurality of power transistors for power supply control of the ignition coils and for feedback control circuits.

The circuit configuration disclosed in this publication has one current detection circuit, and at a glance, the circuit looks as if it has been simplified so that the circuit area can be reduced. However, the use of one current detecting circuit requires longer wires to provide detection signals from the current detection circuit to the four feedback control circuits. Stretching wires around increases wire intersections and closeness of wires, which increase the occurrence of electromagnetic interference and noise. Furthermore, in such a circuit configuration, it is necessary to use additional elements such as diodes to prevent interference among the circuits. In consequence, the common use of a current detection circuit rather increases the whole area of the circuit and production cost, giving rise to an increase in noise on top of that. This problem becomes more serious as the number of cylinders increases.

SUMMARY OF THE INVENTION

The object of this invention is to provide an electronic distribution type ignition system which is superior in noise suppression and which has substantially improved in terms of space economization by common use of circuits and elements.

In order to achieve the above object, an electronic distribution type ignition system comprises switching circuits for power supply, feedback control circuits for limiting current, and current detection circuits, wherein a switching circuit and a feedback control circuit are provided for each ignition coil, and a current detection circuit is provided for every two switching circuits.

Each current detection circuit includes a resistance element of relatively large capacity, and therefore, the current detection circuits occupy a large space when formed on a circuit board or substrate. The common use of the current detection circuits contributes to a notable reduction in size of the circuit board. The resistance elements are used commonly with every two switching circuits, but the feedback control circuits are not put to common use. Therefore, the increase in the wire length due to stretching the wires around is limited to a minimum. In addition, the wire intersections can be obviated, so that the decrease in the noise suppression can be inhibited. The feedback control circuits take up only small areas. Thus, the increase of required space attendant on the termination of the common use of the feedback control circuits is very small, and it becomes unnecessary to use additional elements to prevent interference between the circuits, so that the production cost can be reduced to a fairly low level and savings on the required space can be achieved.

DESCRIPTION OF THE PREFERRED EMBODIMENTS

The electronic distribution type ignition system according to this invention will be described in detail with reference to the preferred embodiments shown in the accompanying drawings.

Figure 1:
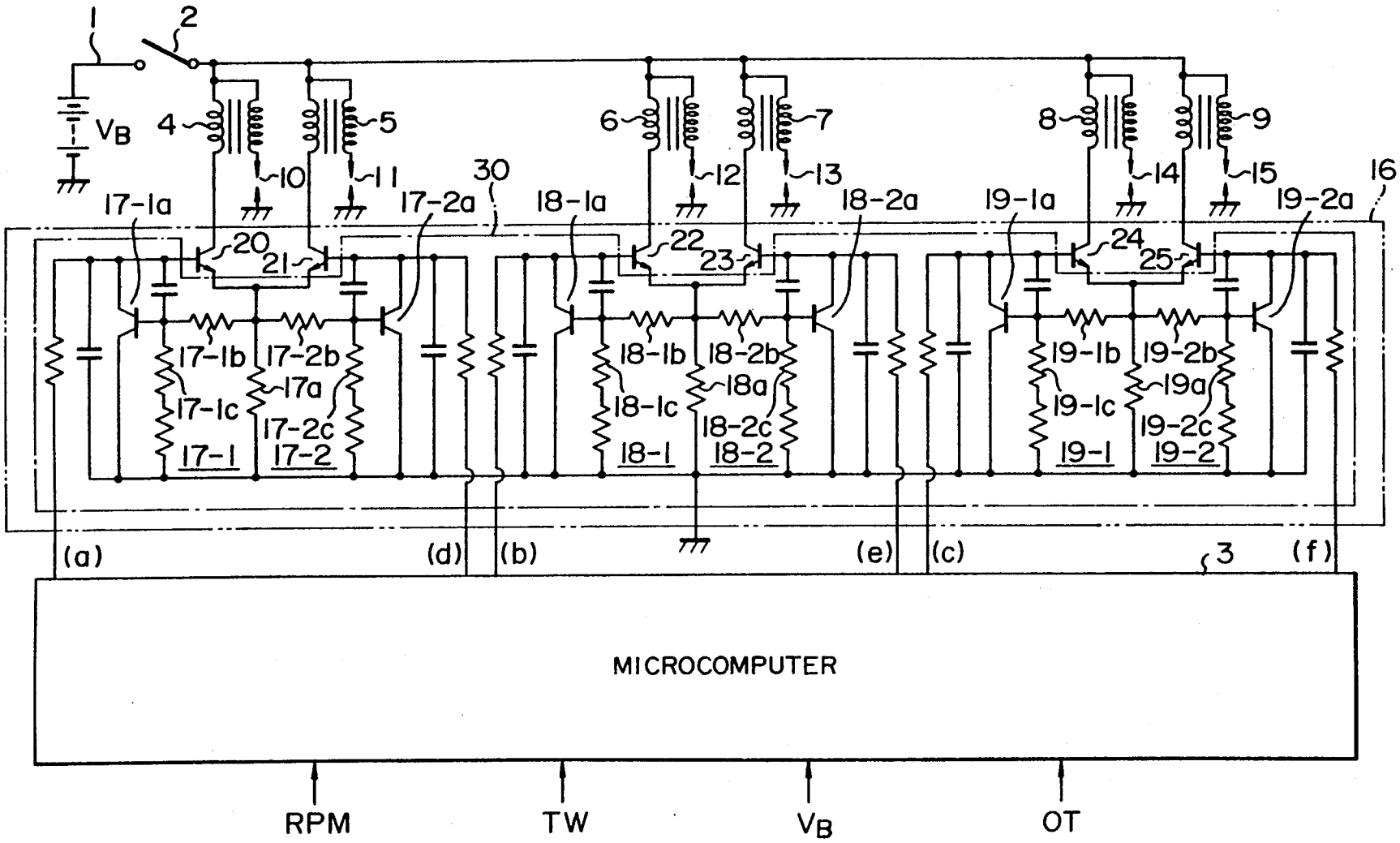
FIG. 1 is a circuit diagram showing an embodiment of the electronic distribution type ignition system according to this invention.

FIG. 1 shows an embodiment of this invention applied to a straight type 6-cylinder gasoline engine. In FIG. 1, reference numerals 4 to 9 indicate ignition coils, that is, six ignition coils are provided for six corresponding spark plugs 10 to 15. Common terminals of primary and secondary coils are connected to a battery 1 through a key switch 2. Terminals on the one side of the secondary coils are directly connected to the spark plugs 10 to 15. The spark plugs are attached to the corresponding cylinders; namely, a spark plug 10 to the first cylinder, a spark plug 11 to the sixth cylinder, a spark plug 12 to the fifth cylinder, a spark plug 13 to the second cylinder, a spark plug 14 to the third cylinder, and a spark plug 15 to the fourth cylinder.

By the above arrangement, ignition control is implemented in a sequence such as:

First cylinder→fifth cylinder→third cylinder→sixth cylinder→second cylinder→fourth cylinder Reference numeral 16 indicates a power switching module which incorporating six power transistors 20 to 25. In these power transistors, their collectors are connected to primary coils of ignition coils 4 to 9, while their emitters are connected in series with the earth through current-detecting resistance elements 17*a*, 18*a*, and 19*a*, respectively.

The current-detecting resistance elements 17*a*, 18*a*, and 19*a* are each provided for a set of two power transistors, namely, the resistance element 17*a* is commonly used with power transistors 20, 21, the resistance element 18*a* commonly used with power transistors 22, 23, and the resistance element commonly used with power transistors 24, 25.

Reference numeral 3 indicates a control unit including a microcomputer. When a voltage $V_B$ is supplied from a battery 1 through the key switch 2, the microcomputer 3 is put into the operating state and receives various items of data representing the operating condition of the engine, such as the engine speed rpm, the cooling water temperature TW, and the throttle opening OP, generates specified ignition control signals (a) to (f), and inputs the ignition control signals into the power switching module 16 so as to apply specified ON and OFF signals to the bases of the power transistors 20 to 25.

On the power switching module 16, a circuit board 30 with thick film circuits is provided. This circuit board 30 has resistance elements 17*a*, 18*a*, and 19*a* mounted thereon. On this circuit board 30, there are six current-limiting circuits 17-1, 17-2, 18-1, 18-2, 19-1, and 19-2 formed such that three symmetric circuits are configured with the above-mentioned resistance elements 17*a*, 18*a*, and 19*a* placed in their center positions. The six current-limiting circuits 17-1, 17-2, 18-1, 18-2, 19-1, and 19-2 and composed of transistors 17-1*a*, 17-2*a*, 18-1*a*, 18-2*a*, 19-1*a*, and 19-2*a*, and resistance elements 17-1*b*, 17-1*c*, 17-2*b*, 17-2*c*, 18-1*b*, 18-1*c*, 18-2*b*, 18-2*c*, 19-1*b*, 19-1*c*, 19 2*b*, and 19-2*c*.

In order to clarify the configuration of these current-limiting circuits, the current-limiting circuit 17-1 will be described as a representative example. The resistance elements 17-1*b* and 17-1*c* take their proportional voltages by dividing therebetween the voltage drop across the current-detecting resistance element 17*a*, so that a predetermined voltage is applied to the base of the transistor 17-1*a*. Meanwhile, the collector and emitter of the transistor 17-1*a* are connected between the base of the power transistor 20 and the ground, and therefore, when the voltage drop across the current-detecting resistance element 17*a* reaches a specified value, the transistor 17-1*a* conducts. This causes the base voltage of the power transistor 20 to drop, and thus, the current-limiting function is performed. In this manner, the current-limiting circuit 17-1 acts as a feedback control circuit to limit a current to be supplied to the ignition coil.

The ignition operation in this embodiment will be next described.

Figure 2:
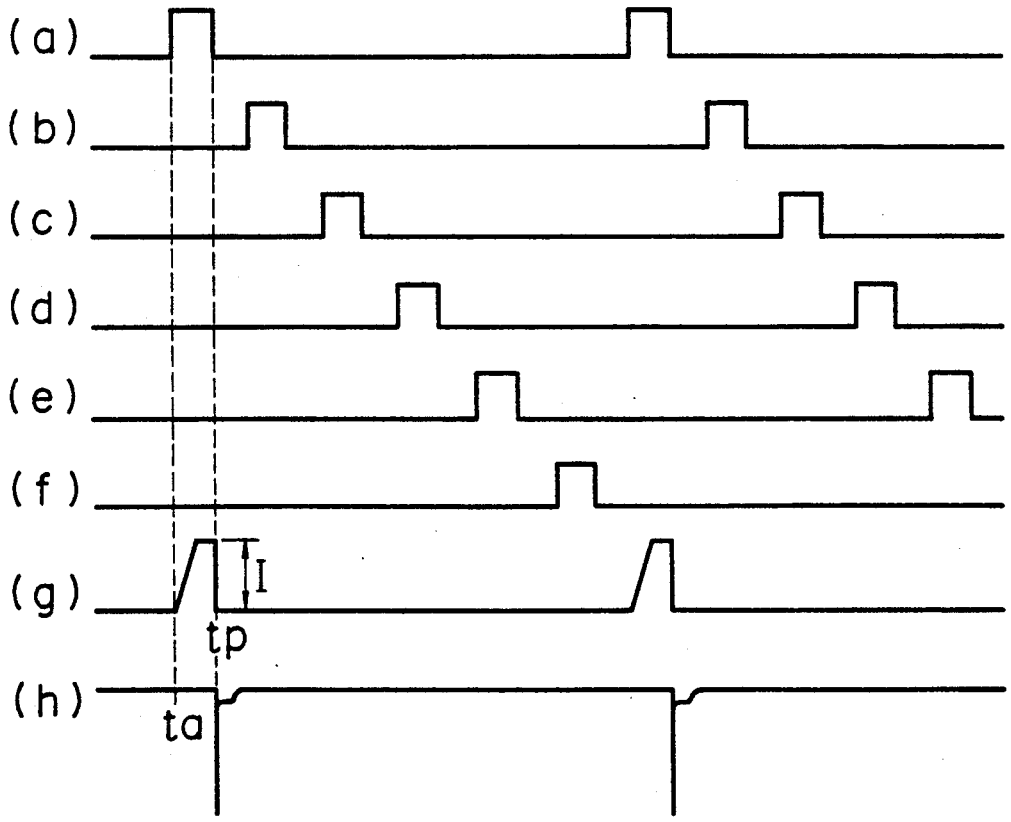
FIG. 2 is a timing chart for explaining the operation of the above embodiment of this invention.

FIG. 2 is a timing chart showing how the ignition control signals (a) to (f) are output by the microcomputer 3. As mentioned above, a signal (a) is an ignition control signal supplied to the base of a power transistor 20 which controls the ignition of the first cylinder, a signal (b) is an ignition control signal supplied to the base of a power transistor 22 for the fifth cylinder, a signal (c) is an ignition control signal supplied to the base of a power transistor 24 for the third cylinder, a signal (d) is an ignition control signal supplied to the base of a power transistor 21 for the sixth cylinder, a signal (e) is an ignition control signal supplied to the base of a power transistor 23 for the second cylinder, and a signal (f) is an ignition control signal supplied to the base of a power transistor 25 for the fourth cylinder. In the present embodiment, the ignition control signals are generated at completely separate timing to preclude overlap in time of the signals. Needless to day, this invention is not limited to this separate generation of the ignition control signals, but the ignition control signals may be issued such that they overlap each other so as to provide compatibility with high-speed engines.

Assume that an ignition control signal (a) is output from the microcomputer 3 at a certain timing $t_a$. Then, the power transistor 20 conducts, and a primary current (g) in the ignition coil 4 rises as shown in FIG. 2. As a result, an IR voltage drop occurs across the current-detecting resistance element 17*a*. When the primary current reaches a predetermined value I, feedback control is effected by the above-mentioned current-limiting circuit 17-1, and this current value I is maintained until the ignition control signal (a) goes to the 0 level at time $t_b$.

When the ignition control signal (a) goes low at time $t_b$, a high voltage develops in the secondary coil of the ignition coil 4, causing a spark to be produced at the spark plug 10, so that ignition takes place in the first cylinder. Therefore, time $t_a$ is the time for starting power supply and time $t_b$ is the time for ignition. By the feedback control by the current-limiting circuit 17-1, the primary current in the ignition coil 4 is limited to a predetermined current value I, so that the ignition energy is kept at a constant value and a steady ignition can be achieved.

In the same manner, power supply is controlled for the other ignition coils 5 to 9, the description of which is therefore be omitted.

Now, let us look at the arrangement of various elements on the circuit board 30 and the state of wiring among the elements in the embodiment of FIG. 1. As is apparent from FIG. 1, the current-limiting circuits and the power transistors are arranged symmetrically about the current-detecting resistance elements 17*a*, 18*a*, and 19*a*, and there is no need for intersections or superfluous stretching around of wires. It ought to be noted that in FIG. 1, of all the ignition control signal lines extending from the microcomputer 3, the ignition control signal lines (d) to (c) cross over the other lines, but these intersections are written to show two-dimensionally the ignition control lines from the microcomputer 3, and when mounting devices on the circuit board 30, the intersections can be obviated by leading out these lines in the upward direction from this circuit diagram.

Figure 3:
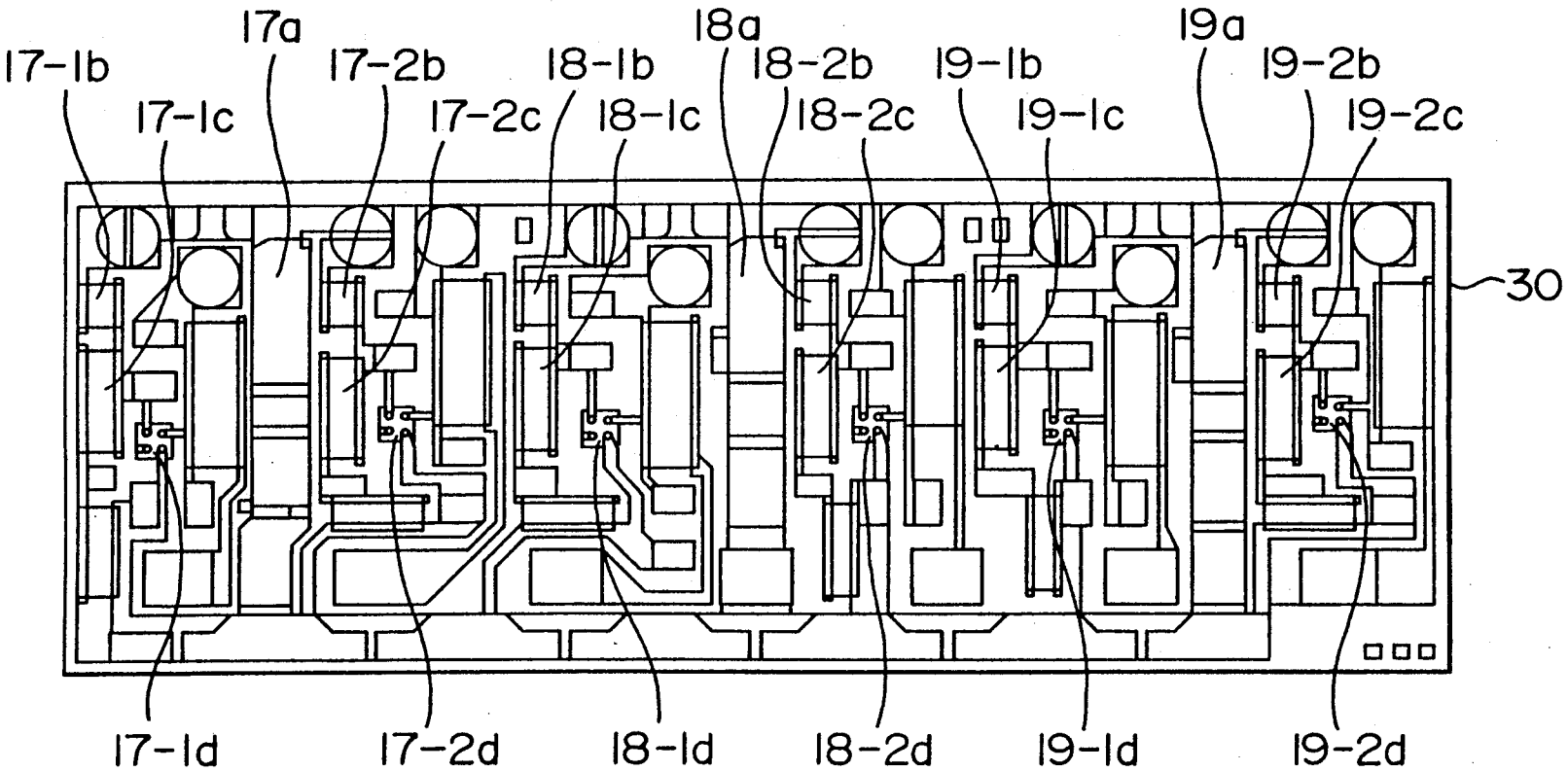
FIG. 3 is a plan view of a wiring pattern formed by applying the above embodiment of this invention to a circuit board.

FIG. 3 shows an embodiment of the pattern on the surface of an actual board when the circuit board 30 of FIG. 1 undergoes a manufacturing process.

The embodiment of FIG. 3 is a thick film circuit formed on a board 30, and has the same reference numerals used for the components identical with the circuit elements of FIG. 1.

Figure 4:
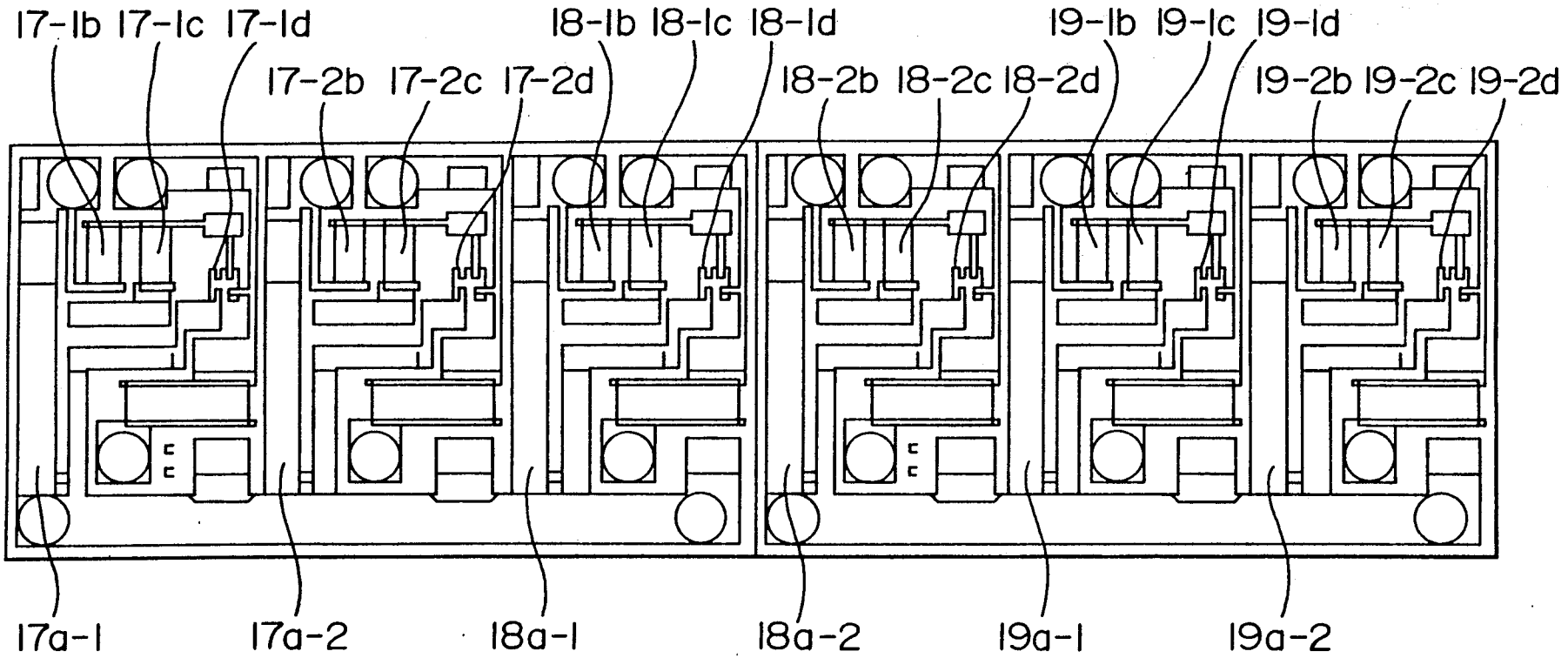
FIG. 4 is a plan view showing an example of a wiring pattern according to the prior art.

For reference, FIG. 4 shows as a prior art a circuit board formed by thick film technology in which a current-limiting resistance element is provided for each of the six ignition coils. Here, the six current-detecting resistance elements are denoted by 17*a*-1, 17*a*-2, 18*a*-1, 18*a*-2, 19*a*-1, and 19*a*-2.

A comparison between the embodiment of this invention of FIG. 3 and the prior art of FIG. 4 clearly shows that according to the embodiment of this invention, the need for two-layer wiring or jumper leads can be obviated, and the board area can be reduced by about 30%.

The board used for the ignition system is reduced to such a small size, and there is not inter-section or superfluous stretching around of wires on the wiring pattern. Therefore, it is easily understandable that according to an embodiment of this invention, sufficient noise suppression can be achieved.

The embodiments in which even numbers of ignition coils are used have been described. When an odd number of ignition coils are used, of course, it is only necessary to provide a current-detecting resistance element, which is not for common use, solely for a single ignition coil.

In the above-mentioned embodiment, the power transistors 20 to 25 are mounted not on the circuit board 30 but on the power switching module. This is because it is assumed that alumina is used for the base material of the thick film circuit. If a ceramic with high thermal conductivity such as AlN is used instead, power transistors 20 to 25 may be mounted directly on the circuit board 30.

Figure 5:
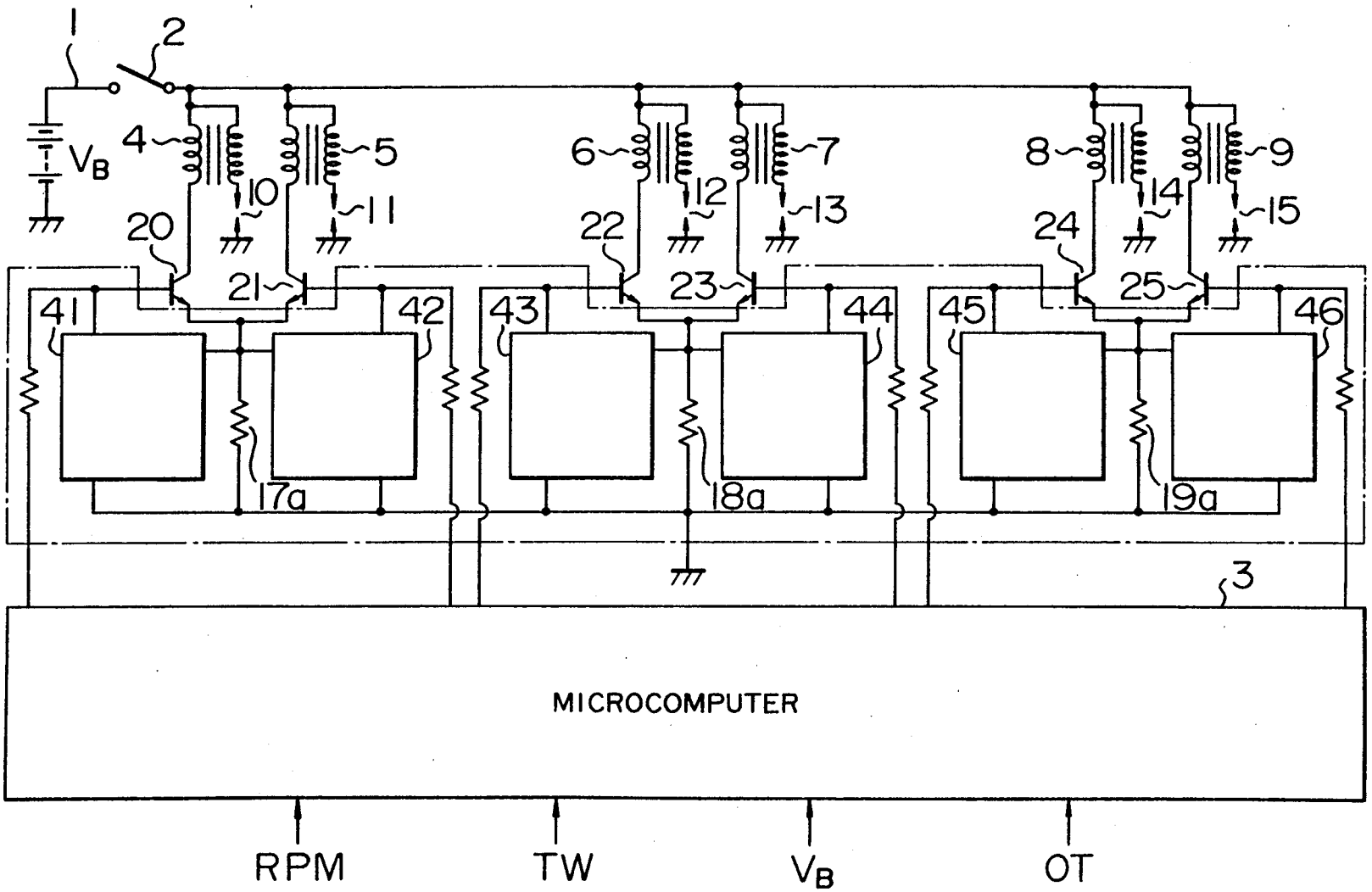
FIG. 5 is a circuit diagram showing another embodiment of this invention.

Description has been made of a case where the current-limiting circuits are used as current control circuits to be installed for the respective ignition coils. If such individual control circuits are drawn as black boxes, the circuit diagram becomes as shown in FIG. 5. In FIG. 5, reference numerals 41 to 46 denote the control circuits shown as black boxes.

In an electronic distribution type ignition system such as this, the control circuits to be installed for the individual ignition coils other than the above-mentioned current-limiting circuits include a duty control circuit and an abnormality occurrence signal circuit. Those circuits are mounted either singly or in combination. If those circuits are mounted, it is only necessary to install various types of circuits mentioned above as the circuits 41 to 46 in the embodiment of FIG. 5. In either case, it is expected that the same effect as in the embodiment of FIG. 1 can be achieved.

As is well known, in the electronic distribution type ignition system, there are a method of using an ignition coil commonly with two spark plugs, the so-called simultaneous discharge method, and what is referred to as the simultaneous ignition method.

Figure 6:
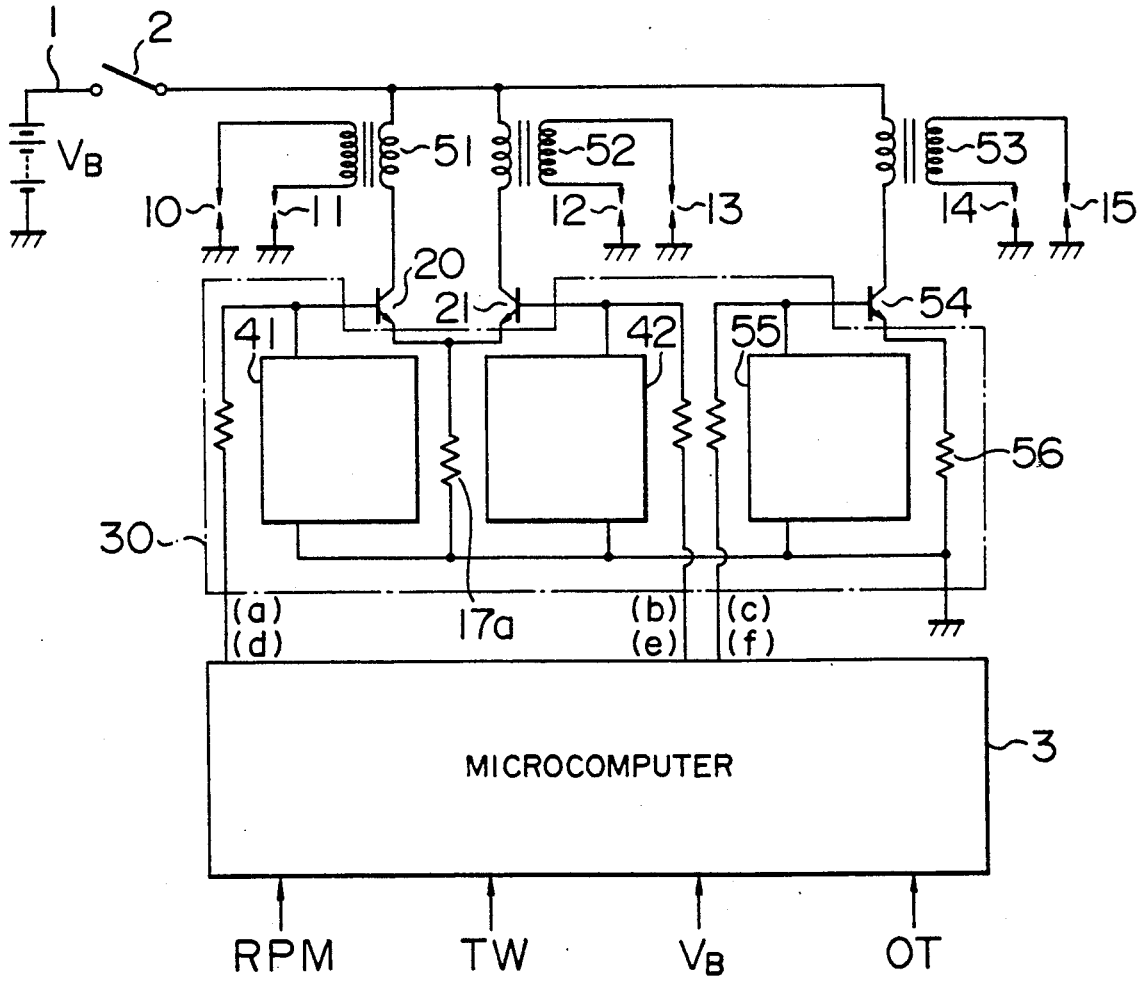
FIG. 6 is a circuit diagram showing yet another embodiment of this invention.

FIG. 6 shows an embodiment in which this invention is applied to the simultaneous discharge method so as to be usable in six-cylinder engines. In this embodiment, three ignition coils 51, 52, and 53 are provided for the simultaneous discharge method in which the three ignition coils supply a high voltage to three sets of two spark plugs 10, 11 and 12, 13, and 14, 15 to control ignition.

In the embodiment of FIG. 6, as mentioned above, three ignition coils 51, 52 and 53 are used. Therefore, a current-detecting resistance element 17*a* is installed commonly with two ignition coils 51 and 52, and a current-detecting resistance element 56 is used solely with the remaining one ignition coil 53. Reference numeral 54 indicates a power transistor for control of power supply to the ignition coil 53, while reference numeral 55 indicates a current-limiting circuit. Needless to say, as mentioned above, a control circuit of some other type may be provided to serve as the current-limiting circuit 55.

Also in the embodiment of FIG. 6 in which only device devoted to common use is the current-detecting resistance element 17*a*, and control circuits 41, 42 are arranged symmetrically about the resistance element 17*a*, sufficient effects including improvements in noise suppression and miniaturization can be expected.

In the foregoing, the embodiments have been described in which this invention is applied to six-cylinder engines. So long as this invention is applied to any engines having two or more cylinders and ignition coils, obviously the same effects can be expected.

According to this invention, only current-detecting resistance elements which require a large space are devoted to common use, and the necessary related circuits can be arranged symmetrically about the resistance elements. Therefore, superfluous stretching around of wires is eliminated, and intersections of wires with large-current lines and large voltage lines can be obviated. Hence, it is possible to easily provide an electronic distribution type ignition system which is superior in noise suppression and allows sufficient size reduction.

We claim:

1. An electronic distribution type ignition system having at least two ignition coils and having the secondary voltage of said ignition coils directly supplied to spark plugs, comprising:

switching circuits for controlling the supply of a primary voltage to said ignition coils;

a resistance element wherein a current flows selectively which corresponds to a primary current for each of two ignition coils, supplied through two of said switching circuits;

current control circuits for detecting a terminal voltage of said resistance element and for controlling, according to said terminal voltage, the primary current flowing through each said ignition coil so as to be at a target value; and a board having said resistance element formed thereon.

2. An electronic distribution type ignition system according to claim 1, wherein said resistance element, is formed of a thick film on said board.

3. An electronic distribution type ignition system according to claim 1, wherein one spark plug is connected to each of said ignition coils.

4. An electronic distribution type ignition system according to claim 1, wherein two spark plugs to which said secondary voltage is supplied simultaneously by said ignition coil are connected to each of said ignition coils.

5. An electronic distribution type ignition system having at least two ignition coils and having the secondary voltage of said ignition coils directly supplied to spark plugs, comprising:

switching circuits for controlling the supply of a primary voltage to said ignition coils;

a resistance element wherein a current flows selectedly which corresponds to a primary current for each of two ignition coils, supplied through two of said switching circuits;

current control circuits for detecting a terminal voltage of said resistance element and for controlling, according to said terminal voltage, the primary current flowing through each said ignition coil so as to be at a target value; and a board having said resistance element and said current control circuits formed of a thick film circuit thereon.

6. An electronic distribution type ignition system according to claim 5, wherein two of said current control circuits are formed with said one resistance element placed therebetween.

7. An electronic distribution type ignition system according to claim 5, wherein said switching circuits are arranged on said board.

8. An electronic distribution type ignition system according to claim 5, wherein one spark plug is connected with each of said ignition coils.

9. An electronic distribution type ignition system according to claim 5, wherein two spark plugs to which said secondary voltage is supplied simultaneously by said ignition coil is connected to each of said ignition coils.

* * * * *